US009719274B2

(12) United States Patent
Allred et al.

(10) Patent No.: US 9,719,274 B2
(45) Date of Patent: Aug. 1, 2017

(54) DOOR HANDLES INCLUDING HAND SANITIZER DELIVERY SYSTEMS, AND RELATED METHODS

(71) Applicant: Seton Healthcare Family, Austin, TX (US)

(72) Inventors: James Allred, Austin, TX (US); C. Kenneth French, Austin, TX (US)

(73) Assignee: SETON HEALTHCARE FAMILY, Austin, TX (US)

( * ) Notice: Subject to any disclaimer, the term of this patent is extended or adjusted under 35 U.S.C. 154(b) by 0 days.

(21) Appl. No.: 14/705,073

(22) Filed: May 6, 2015

(65) Prior Publication Data

US 2016/0230418 A1 Aug. 11, 2016

Related U.S. Application Data

(60) Provisional application No. 62/113,861, filed on Feb. 9, 2015.

(51) Int. Cl.
*E05B 1/00* (2006.01)
*E05C 1/12* (2006.01)
(Continued)

(52) U.S. Cl.
CPC ..... *E05B 1/0069* (2013.01); *B05B 11/3052* (2013.01); *E05B 15/0033* (2013.01);
(Continued)

(58) Field of Classification Search
CPC ..... E05B 1/0069; E05B 17/0041; E05B 17/0045; E05B 77/42; E05C 1/12;
(Continued)

(56) References Cited

U.S. PATENT DOCUMENTS 4,046,508 A 9/1977 McDonald ..... 4/222
4,202,471 A * 5/1980 Fegley ..... G08B 15/02 222/153.11

(Continued)

FOREIGN PATENT DOCUMENTS

EP 2428627 4/2014
WO WO 2014/035610 3/2014

OTHER PUBLICATIONS

Purehold http://www.purehold.co.uk/ accessed on Oct. 8, 2015.

(Continued)

*Primary Examiner* — Frederick C Nicolas
(74) *Attorney, Agent, or Firm* — Norton Rose Fulbright US LLP

(57) ABSTRACT

Some embodiments of the present door handles include a housing, a hand sanitizer delivery system coupled to the housing, the hand sanitizer delivery system having a reservoir configured to contain hand sanitizer, a nozzle in selective fluid communication with the reservoir, and a pump configured to communicate hand sanitizer from the reservoir to the nozzle, and a first lever movably coupled to the housing, where the housing is configured to be mounted to a door having a movable latch such that movement of the first lever a first distance in a first direction actuates the door latch, and where the hand sanitizer delivery system can be actuated independently of the door latch. In some embodiments, the housing is configured to be mounted to the door such that movement of the first lever a second distance, smaller than the first distance, in the first direction actuates the hand sanitizer delivery system.

21 Claims, 17 Drawing Sheets

(51) Int. Cl.

| | |
|---|---|
| ***B05B 11/00*** | (2006.01) |
| ***E05B 15/00*** | (2006.01) |
| ***E05C 1/14*** | (2006.01) |
| *E05B 77/42* | (2014.01) |
| *B65D 47/40* | (2006.01) |
| *E05B 17/00* | (2006.01) |

(52) U.S. Cl.
CPC ..... *E05C 1/14* (2013.01); *B65D 47/40* (2013.01); *E05B 17/0041* (2013.01); *E05B 17/0045* (2013.01); *E05B 77/42* (2013.01); *E05C 1/12* (2013.01); *Y10T 137/5762* (2015.04)

(58) Field of Classification Search
CPC ..... E05C 1/14; B05B 11/3052; B65D 47/40; Y10T 137/5762
See application file for complete search history.

(56) References Cited

U.S. PATENT DOCUMENTS

| | | | | |
|---|---|---|---|---|
| 6,029,600 | A | 2/2000 | Davis | 116/200 |
| 7,320,418 | B2 | 1/2008 | Sassoon | 222/649 |
| 7,458,742 | B2 | 12/2008 | Stropkay et al. | 401/205 |
| 7,878,371 | B2 | 2/2011 | Sassoon | 222/52 |
| 8,061,565 | B1 | 11/2011 | Baker | 222/192 |
| 8,061,656 | B1 | 11/2011 | Renn et al. | 244/122 |
| 8,152,027 | B1 * | 4/2012 | Baker | A61L 2/18 222/1 |
| D670,552 | S | 11/2012 | Meeks | D8/301 |
| D678,070 | S | 3/2013 | Meeks | D9/521 |
| D678,748 | S | 3/2013 | Meeks | D8/301 |
| 8,408,423 | B1 | 4/2013 | McKnight et al. | 222/192 |
| 8,505,782 | B1 | 8/2013 | Gardiner et al. | 222/192 |
| 8,636,177 | B1 | 1/2014 | Gardiner et al. | 222/192 |
| 8,777,064 | B2 * | 7/2014 | Williams | A61L 2/22 16/412 |
| 9,255,423 | B2 * | 2/2016 | Oshmyansky | A61L 2/18 |
| 2004/0223894 | A1 * | 11/2004 | Gilbert | A61L 2/18 422/292 |
| 2004/0237255 | A1 * | 12/2004 | Lin | E05B 1/0069 16/110.1 |
| 2008/0305020 | A1 | 12/2008 | Oshmyansky | 422/291 |
| 2012/0080451 | A1 | 4/2012 | Williams et al. | 222/181.3 |
| 2013/0279966 | A1 | 10/2013 | Roberts et al. | 401/207 |

OTHER PUBLICATIONS

Pull Clean https://www.pullclean.com/ accessed on Oct. 8, 2015.
Altitude Medical http://www.altitudemedical.com/ accessed on Oct. 8, 2015.

* cited by examiner

FIG. 2A – PRIOR ART

DOOR HANDLES INCLUDING HAND SANITIZER DELIVERY SYSTEMS, AND RELATED METHODS

CROSS-REFERENCE TO RELATED APPLICATION

This application claims priority to U.S. Provisional Patent Application No. 62/113,861 filed Feb. 9, 2015, which is incorporated by reference in its entirety.

BACKGROUND

1. Field of Invention

The present invention relates generally to door handles, and more specifically, but not by way of limitation, to door handles including hand sanitizer delivery systems.

2. Description of Related Art

Infections, and particularly nosocomial infections, can be life-threatening and resistant to treatment. Hand sanitization may be an important step in mitigating the spread of such infections and should be practiced by individuals in a hospital setting, whether they are health care providers, patients, visitors, and/or the like. For example, for a health care provider, it is generally advisable to practice hand sanitization before patient contact, after patient contact and/or contact with potentially contaminated surfaces, and/or the like. However, existing hand sanitizer dispensers may not be adequately accessible to practice such frequent hand sanitization.

Some hand sanitizer dispensers may be door-mounted. However, such hand sanitizer dispensers may be incapable of dispensing hand sanitizer without actuating a door latch of the door. Some such hand sanitizer dispensers may be incapable of actuating a door latch of the door without dispensing hand sanitizer.

Examples of door-mounted hand sanitizer dispensers are disclosed in U.S. Pat. No. No. 8,061,565 and Pub. No. US 2008/0305020 A1.

SUMMARY

Some embodiments of the present door handles are configured such that a hand sanitizer delivery system of the door handle can be actuated independently of a door latch (e.g., through a first lever movably coupled to a housing of the door handle and movable: (1) a first distance in a first direction to actuate the door latch; and (2) a second distance, smaller than the first distance, in the first direction to actuate the hand sanitizer delivery system but not the door latch). Some embodiments are configured such that the door latch can be actuated independently of the hand sanitizer delivery system (e.g., through a second lever movably coupled to the housing and movable in the first direction independently of the first lever).

In contrast, hand sanitizer dispensers that are incapable of dispensing hand sanitizer without actuating a door latch may be impractical for use by certain individuals wishing to practice hand sanitization, for example, an individual passing by the hand sanitizer dispenser (e.g., in a hallway), any individual when the door is open, a second or subsequent visitor to a patient's room, and/or the like, may be required to unnecessarily actuate the door latch to obtain hand sanitizer, which may be disruptive to a surrounding environment and/or harmful to patient perception. Similarly, hand sanitizer dispensers that are incapable of actuating a door latch without dispensing hand sanitizer may be impractical for use by certain individuals who do not wish to dispense hand sanitizer, such as, for example, non-health care providers, custodial staff, individuals with allergies to certain hand sanitizers, and/or the like.

Some embodiments of the present door handles comprise: a housing; a hand sanitizer delivery system coupled to the housing (the hand sanitizer delivery system comprising: a reservoir configured to contain hand sanitizer; a nozzle in selective fluid communication with the reservoir; and a pump configured to communicate hand sanitizer from the reservoir to the nozzle); and a first lever movably coupled to the housing; where the housing is configured to be mounted to a door having a movable latch such that: movement of the first lever a first distance in a first direction actuates the door latch; and the hand sanitizer delivery system can be actuated independently of the door latch.

In some embodiments, the door handle comprises a sensor configured to capture data indicative of a presence of an object beneath the nozzle, and the hand sanitizer delivery system is configured to actuate based, at least in part, on data captured by the sensor. In some embodiments, at least a portion of the first lever extends above the nozzle such that the first lever can be moved relative to the housing without actuating the hand sanitizer delivery system. In some embodiments, the first lever comprises a first portion and a second portion extending from the first portion and above the nozzle, where the second portion is disposed at a non-parallel angle relative to the first portion.

In some embodiments, movement of the first lever in the first direction moves the first lever closer to the nozzle. In some embodiments, the first lever defines a lip configured to facilitate movement of the first lever relative to the housing.

In some embodiments, the housing is configured to be mounted to the door having the movable latch such that movement of the first lever a second distance in the first direction actuates the hand sanitizer delivery system, the second distance being smaller than the first distance. In some embodiments, the first direction is away from the door. In other embodiments, the first direction is towards the door. Some embodiments comprise: a second lever movably coupled to the housing and configured such that: movement of the first lever the first distance in the first direction moves the second lever to actuate the door latch; and movement of the first lever relative to the second lever a second distance in the first direction actuates the hand sanitizer delivery system, the second distance being smaller than the first distance.

Some embodiments of the present door handles comprise: a housing; a hand sanitizer delivery system coupled to the housing (the hand sanitizer delivery system comprising: a reservoir configured to contain hand sanitizer; a nozzle in selective fluid communication with the reservoir; and a pump configured to communicate hand sanitizer from the reservoir to the nozzle); a first lever movably coupled to the housing; and a second lever movably coupled to the housing; where the housing is configured to be mounted to a door having a movable latch such that: movement of the first lever a first distance in a first direction moves the second lever to actuate the door latch; and movement of the first lever relative to the second lever a second distance in the first direction actuates the hand sanitizer delivery system, the second distance being smaller than the first distance. In some embodiments, the first lever is spaced apart from the second lever in a second direction that is opposite the first direction. In some embodiments, movement of the first lever the second distance in the first direction does not move the second lever. In some embodiments, movement of the second lever does not move the first lever.

In some embodiments of the present door handles, the first direction is away from the door. In some embodiments, the first lever comprises a projection configured to engage the second lever. In some embodiments, the first direction is towards the door.

In some embodiments, the first lever defines a recess configured to receive at least a portion of the second lever. In some embodiments, the second lever defines a recess configured to receive at least a portion of the first lever. In some embodiments, the second lever is disposed behind an outer surface of the housing. In some embodiments, the first lever is disposed behind an outer surface of the housing.

Some embodiments of the present door handles comprise a linkage extending from the housing, the linkage configured to extend into the door and be coupled to the latch.

In some embodiments of the present door handles, the nozzle is disposed behind an outer surface of the housing. In some embodiments, the nozzle is disposed beneath the reservoir. In some embodiments, the nozzle is configured to communicate hand sanitizer in a downward direction. In some embodiments, the housing comprises a finger grip configured to facilitate movement of the first lever relative to the housing.

Some embodiments of the present door handles comprise: a drip tray coupled to the housing and disposed below the nozzle. In some embodiments, the drip tray defines a recess configured to receive hand sanitizer.

Some embodiments of the present door handles comprise: a speaker configured to emit a sound upon actuation of the hand sanitizer delivery system.

Some embodiments of the present door handle assemblies comprise: a first one of the present door handles disposed on a first side of a door having a door latch; a second one of the present door handles disposed on a second side of the door; where the first door handle is configured such that movement of the first lever the first distance in the first direction actuates the door latch; and where the second door handle is configured such that movement of the first lever the first distance in the first direction actuates the door latch.

Some embodiments of the present methods comprise: moving a first lever of a door handle a first distance in a first direction to actuate a door latch; moving the first lever a second distance in the first direction to actuate a hand sanitizer delivery system coupled to the door handle without actuating the door latch; where the second distance is smaller than the first distance. In some embodiments, moving the first lever the first distance moves a second lever of the door handle to actuate the door latch.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

FIG. 2A is a perspective view of a prior art door latch suitable for use with some embodiments of the present door handles.

DETAILED DESCRIPTION OF ILLUSTRATIVE EMBODIMENTS

Figure 1A:
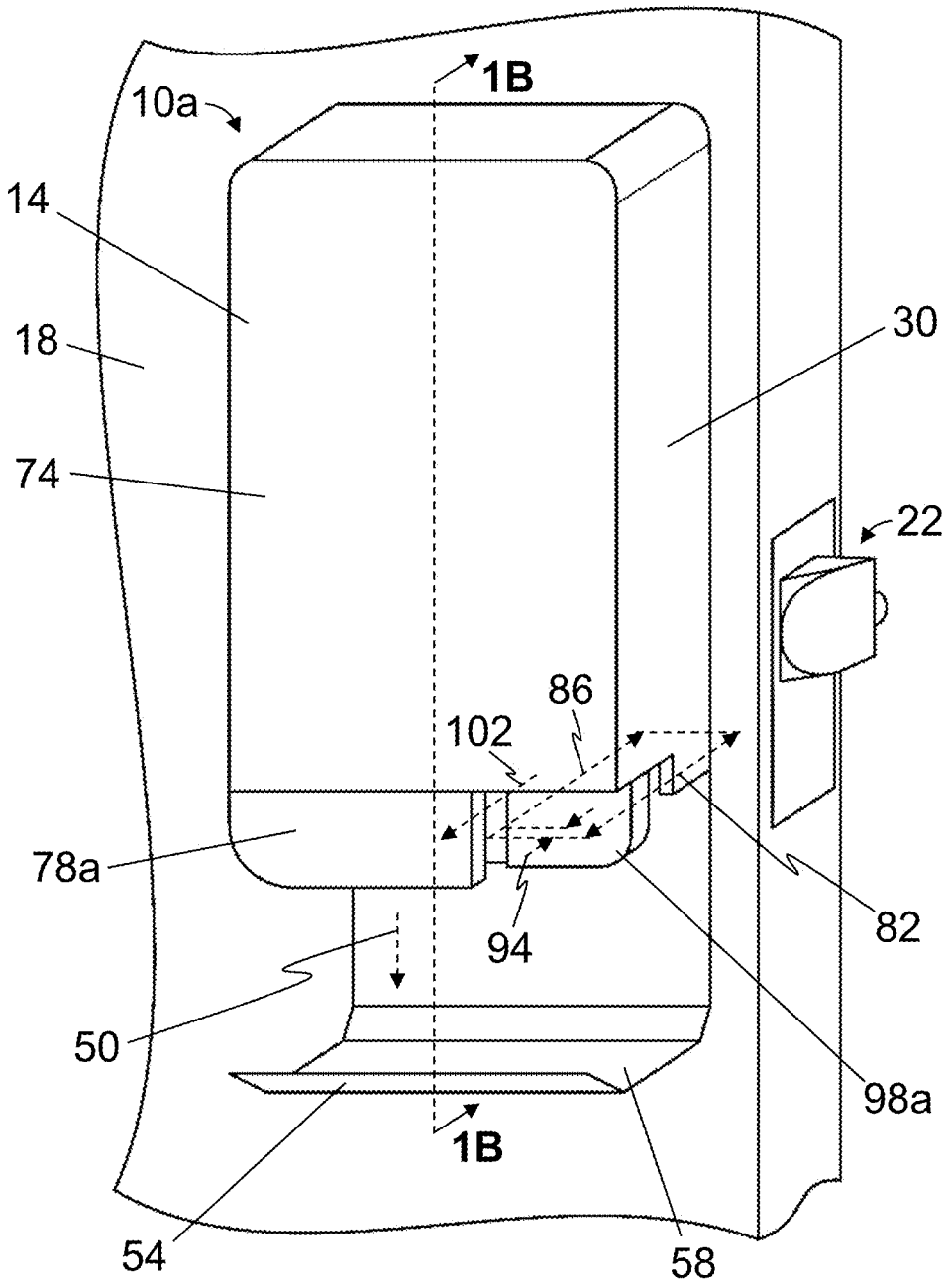
FIG. 1A is a front perspective view of a first embodiment of the present door handles.

Referring now to the drawings, and more particularly to FIGS. 1A-1D, shown therein and designated by the reference numeral 10*a* is a first embodiment of the present door handles. In the embodiment shown, door handle 10*a* comprises a housing 14 configured to be mounted to a door 18 that has a movable latch 22. Such mounting can be accomplished in any suitable fashion, such as, for example, via screws, bolts, or other fasteners, adhesives, and/or the like.

Figure 1B:
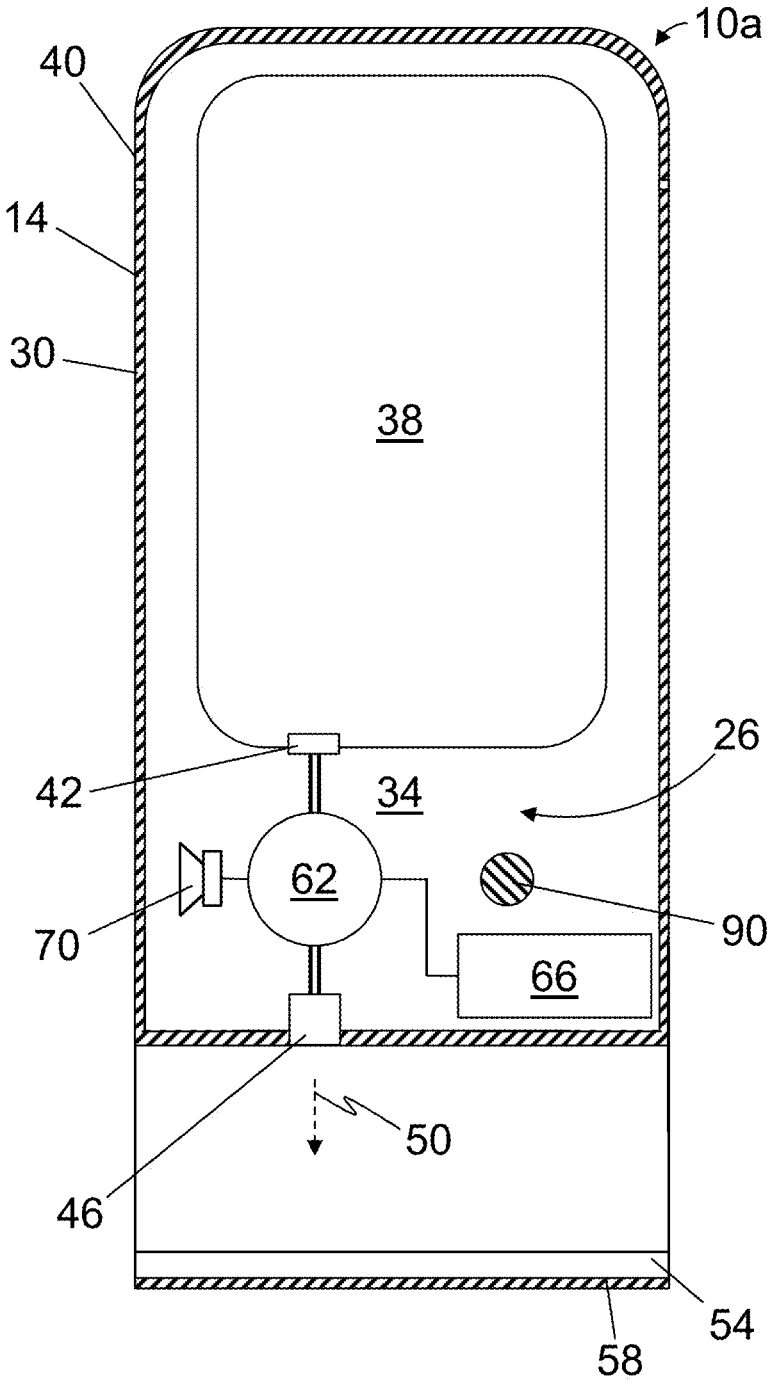
FIG. 1B is a partially cross-sectional front view taken along line 1B-1B of FIG. 1A, with various components shown schematically.
Figure 1C:
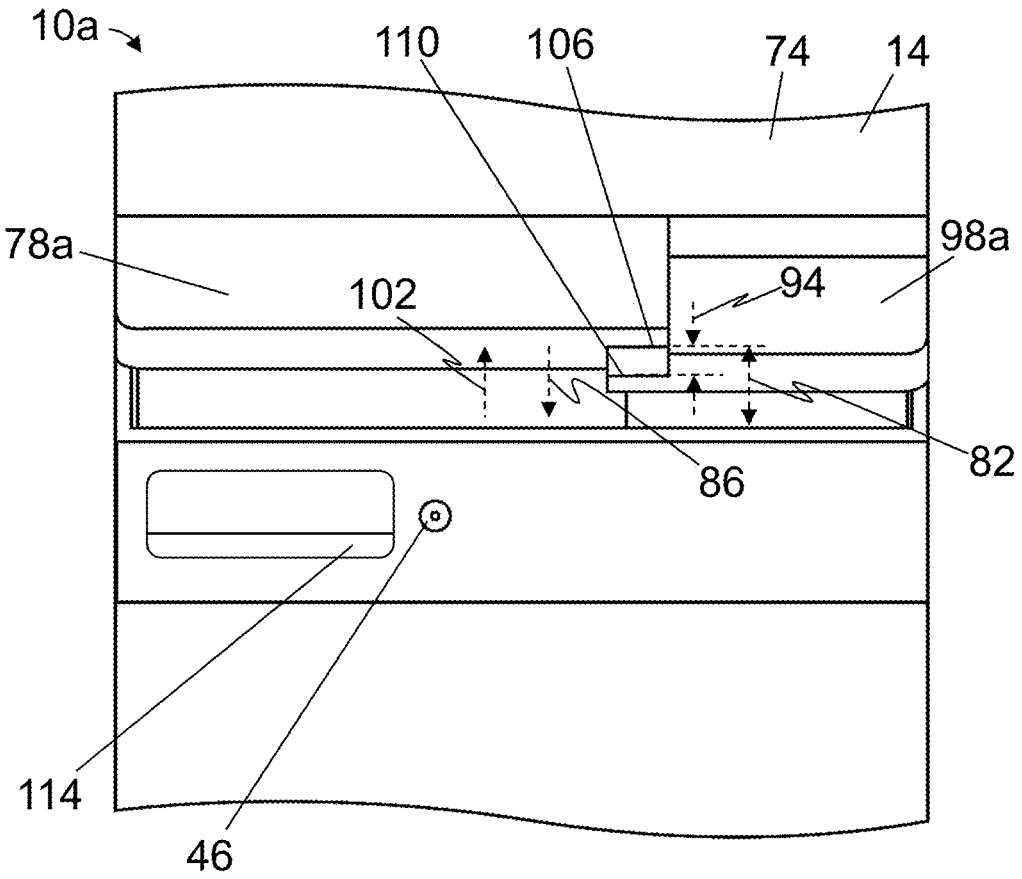
FIG. 1C is a cutaway bottom perspective view of the embodiment of FIG. 1A.
Figure 1D:
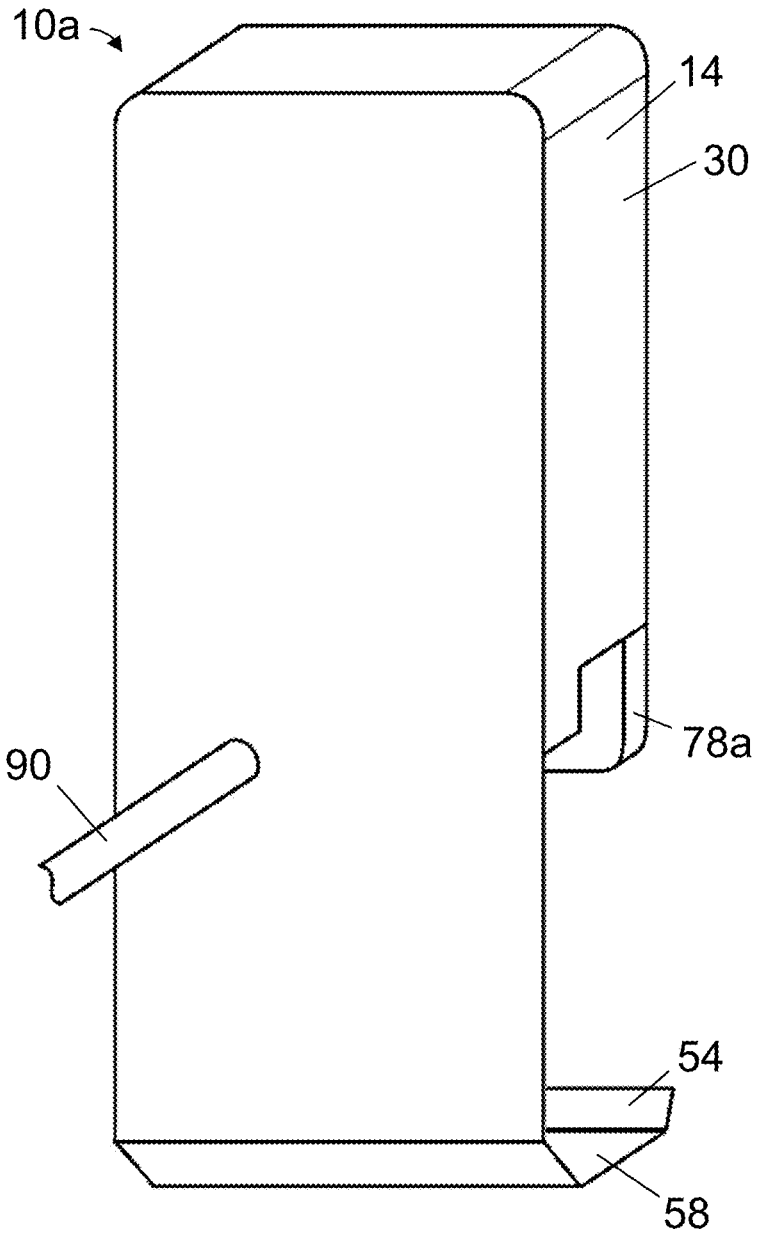
FIG. 1D is a back perspective view of the embodiment of FIG. 1A.

In the embodiment shown, door handle 10*a* comprises a hand sanitizer delivery system 26 coupled to housing 14. For example, in the depicted embodiment, housing 14 comprises a sidewall 30 that defines an interior volume 34, within which hand sanitizer delivery system 26 is at least partially disposed (FIG. 1B). Hand sanitizers suitable for use with the present door handles can comprise any suitable hand sanitizer, whether gel, foam, liquid, and/or the like, and may include solid particulates.

In the embodiment shown, hand sanitizer delivery system 26 comprises a reservoir 38 configured to contain hand sanitizer. Reservoirs of the present door handles, and more particularly, of the present hand sanitizer delivery systems, can comprise any suitable reservoir, whether flexible and/or inflexible. In this embodiment, housing 14 and hand sanitizer delivery system 26 are configured such that reservoir 38 is removable and replaceable. For example, in the depicted embodiment, reservoir 38 comprises a port 42 configured to be coupled in fluid communication with a nozzle 46, and housing 14 may be configured to allow reservoir 38 to be removed from and/or installed into interior volume 34 (e.g., via an access hatch 40 movably coupled to and/or removable from housing 14 to allow access to interior volume 34). In other embodiments, reservoirs may be refillable (e.g., via a port, which may be accessible from an exterior of the housing).

In the depicted embodiment, hand sanitizer delivery system 26 comprises a nozzle 46 in selective fluid communication with reservoir 38 (e.g., selective fluid communication between reservoir 38 and nozzle 46 may be controlled by a pump 62, described in more detail below). Nozzles of the present door handles, and more particularly, of the present hand sanitizer delivery systems, can comprise any suitable nozzle, whether spray- and/or stream type (e.g., and a nozzle may be selected depending on the type of hand sanitizer to be communicated by the nozzle). In the embodiment shown, nozzle 46 is configured to communicate hand sanitizer in a downward direction (e.g., in a direction generally indicated by arrow 50). In at least this way, door handle 10*a*, and more particularly, hand sanitizer delivery system 26, is configured to limit the presence of hand sanitizer on components that a user must contact to actuate door latch 22 and/or the hand sanitizer delivery system (e.g., first lever 78*a* and/or second lever 98*a*, described in more detail below), which may be unpleasant to the user and/or discourage subsequent uses of the door handle.

In this embodiment, door handle 10*a* comprises a drip tray 54 coupled to (e.g., integrally formed with) housing 14 and disposed below nozzle 46 a sufficient distance below nozzle 46 to permit a user to insert a hand between the nozzle and the tray to receive hand sanitizer. In the depicted embodiment, drip tray 54 is configured to limit the disposal of hand sanitizer on a floor surface during operation of hand sanitizer delivery system 26 (e.g., which may present a slipping hazard). For example, in this embodiment, drip tray 54 defines a recess 58 to help retain hand sanitizer dispensed from nozzle 46 that is not deposited on or spills from a user's hand.

In the embodiment shown, hand sanitizer delivery system 26 comprises a pump 62 configured to communicate hand sanitizer from reservoir 38 to nozzle 46 (FIG. 1B). Pumps of the present door handles, and more particularly of the present hand sanitizer delivery systems, can comprise any suitable pump, such as, for example, a lobe pump, gear pump, peristaltic pump, piston pump, plunger pump, and/or the like. In this embodiment, pump 62 is an electrically-actuated pump (e.g., which may receive power from one or more batteries 66). However, in other embodiments, pump 62 may be mechanically-actuated. For example, in some embodiments, a pump may comprise a paddle, which may be mechanically linked to a lever such that the paddle applies pressure to a reservoir (or a portion thereof) upon movement of the lever. In other embodiments, a valve may be used in place of pump 62 to simply permit hand sanitizer to be carried downward to the nozzle (when the valve is open).

In the depicted embodiment, door handle 10*a* and/or hand sanitizer delivery system 26 comprises a speaker 70 configured to emit a sound upon actuation of the hand sanitizer delivery system. For example, in this embodiment, speaker 70 is in electrical communication with pump 62 and one or more batteries 66 such that, when the pump is actuated, speaker 70 emits a sound. In some embodiments, the speaker is configured to emit a sound when the door latch is actuated. In some embodiments, the speaker is configured to emit a sound only when the door latch is actuated but the dispensing system 26 is not. In at least these ways, a user may be encouraged to utilize hand sanitizer delivery system 26 of door handle 10*a* (e.g., speaker 70 may serve as a reminder to the user to utilize the hand sanitizer delivery system and/or may alert others nearby as to whether the user has utilized the hand sanitizer delivery system).

In some embodiments of the present door handles, the housings and hand sanitizer delivery systems are configured to resemble and/or have the look and feel of a traditional hand sanitizer dispenser. For example, in some embodiments (e.g., 10*a*, 10*b*, and/or the like), the housing (e.g., 14) is elongated (e.g., in a direction that is vertical in use), a nozzle (e.g., 46) is disposed within an outer peripheral surface (e.g., 74) of the housing (e.g., behind a forward-most surface), the nozzle (e.g., 46) is disposed beneath the reservoir (e.g., 38), and/or the like. In these ways and others, certain embodiments of the present door handles may be configured to encourage use of hand sanitizer delivery systems (e.g., by presenting readily-recognizable structures to a user and/or an observer of the user, such that the user and/or observer may intuitively apprehend the hand sanitizing functions of the present door handles).

In the embodiment shown, door handle 10*a*, and more particularly, housing 14, is configured to be coupled to door 18 such that the door handle can actuate door latch 22. For example, in this embodiment, door handle 10*a* comprises a first lever 78*a* movably (e.g., slidably, pivotally, and/or the like) coupled to housing 14 and configured such that movement of the first lever a first distance 82 in a first direction 86 actuates door latch 22 (e.g., to permit the door to be opened from a closed position). For example, in the depicted embodiment, door handle 10*a* comprises a linkage 90 extending from housing 14 (FIG. 1D) and configured to extend into door 18 to be coupled to door latch 22, where movement of first lever 78*a* first distance 82 in first direction 86 moves the linkage to actuate the door latch (e.g., by moving a second lever 98*a* coupled to the linkage, as described in more detail below). In the depicted embodiment, first direction 86 is generally towards the door (e.g., first lever 78*a* is a push-type lever).

In the embodiment shown, hand sanitizer delivery system 26 can be actuated independently of door latch 22. To illustrate, in the embodiment shown, movement of first lever 78*a* a second distance 94 (that is smaller than first distance 82) in first direction 86 actuates hand sanitizer delivery system 26 (e.g., by actuating pump 62), but not door latch 22. For example, in this embodiment, door handle 10*a* comprises a second lever 98*a* movably (e.g., slidably, pivotally, and/or the like) coupled to housing 14 and coupled to linkage 90 (e.g., such that movement of second lever 98*a* in first direction 86 actuates door latch 22). In the depicted embodiment, second lever 98*a* is configured such that movement of first lever 78*a* first distance 82 in first direction 86 moves the second lever to actuate door latch 22, and movement of the first lever relative to the second lever second distance 94 in the first direction actuates hand sanitizer delivery system 26. In other words, in the embodiment shown, movement of first lever 78*a* second distance 94 in first direction 86 does not move second lever 98*a*. For example, in this embodiment, first lever 78*a* is spaced apart from second lever 98*a* in a second direction 102 that is opposite first direction 86. In the depicted embodiment, first lever 78*a* is configured to engage second lever 98*a* as the first lever is moved beyond second distance 94 in first direction 86. For example, in the embodiment shown, first lever 78*a* includes a recessed portion 106 (e.g., such as may be defined by a recess on a rear surface of lever 78*a*, and having a reduced thickness relative to other portions of the first lever) configured to receive and/or engage at least a portion of second lever 98*a*. Similarly, in this embodiment, second lever 98*a* includes a recessed portion 110 (e.g., such as may be defined by a recess on a front surface of lever 98*a*, and having a reduced thickness relative to other portions of the second lever) configured to receive and/or engage at least a portion (e.g., recessed portion 106) of first lever 78*a*. In some embodiments, features and/or components configured to facilitate engagement of a first lever (e.g., 78*a*) with a second lever (e.g., 98*a*), such as, for example, a recessed portion (e.g., 106), a recessed portion (e.g., 110), and/or the like, may be substantially disposed within a housing (e.g., 14), such that, for example, a risk of a user pinching their hand or fingers (e.g., between the first lever and the second lever) may be reduced.

In the depicted embodiment, door latch 22 may be actuated independently of hand sanitizer delivery system 26. For example, in the embodiment shown, second lever 98*a* can be moved in first direction 86 without moving first lever 78*a*.

In these and similar ways, hand sanitizer may be dispensed from door handle 10*a*, without actuation of door latch 22 (e.g., without movement of linkage 90) such that, for example, environmental disruptions caused by actuation of the door latch may be avoided, the door handle may function as and/or replace a traditional hand sanitizer dispenser, and/or the like. In this embodiment, housing 14 comprises and/or defines a finger grip 114 (e.g., a recess and/or protrusion) (FIG. 1C) configured to facilitate movement of first lever 78*a* relative to the housing (e.g., particularly when door 18 is in an open position, such that a user may actuate the first lever to dispense hand sanitizer, while minimizing movement of the door).

Referring additionally to FIG. 2A, shown is a perspective view of a prior art door latch 22*a* suitable for use with some embodiments of the present door handles (e.g., 10*a*, 10*b*, and/or the like). In the embodiment shown, bolt 118*a* of door latch 22*a* is movable between a retracted position and a deployed position (e.g., generally along a direction indicated by arrow 120) via rotation of a hub 122 of the door latch relative to a casing 126*a* of the door latch (e.g., generally along a direction indicated by arrow 124) (e.g., door latch 22*a* is or is similar to a traditional door latch).

Figure 2B:
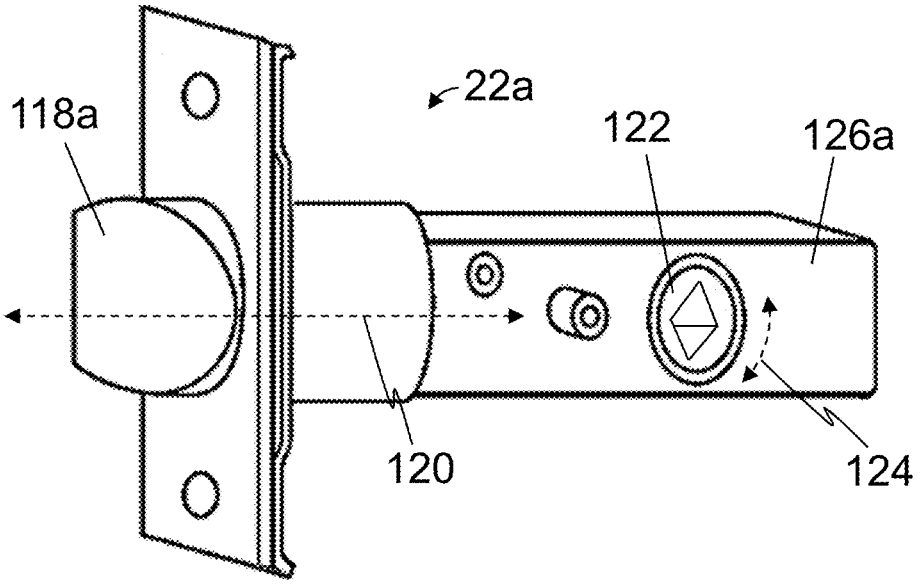
FIG. 2B is a cutaway front perspective view of a mechanism or linkage, suitable for use with some embodiments of the present door handles, for converting rotation about a first axis into rotation about a second axis that is non-parallel to the first axis.
Figure 2B:
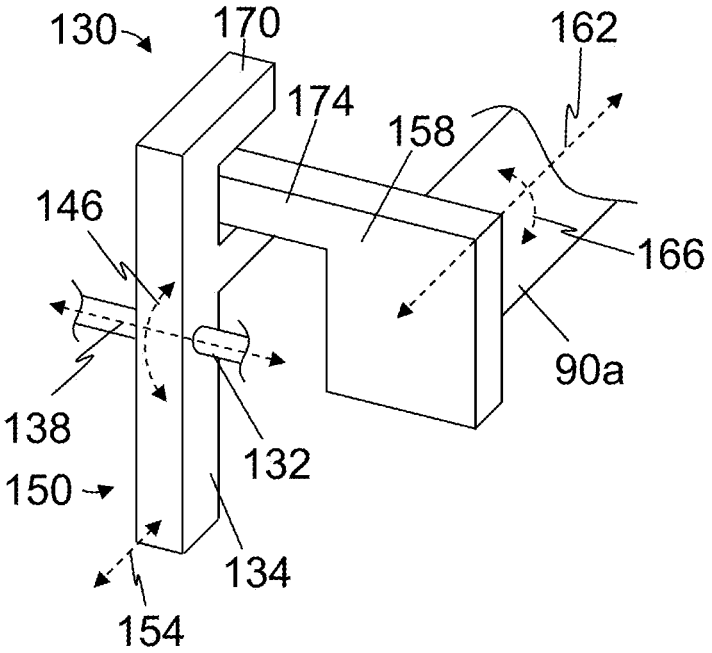

In these and similar embodiments, translational movement of a lever (e.g., 78*a*, 78*b*, 98*a*, 98*b*, and/or the like) may be mechanically converted into rotational movement of a linkage (e.g., 90) by a mechanism (e.g., which may be disposed within a housing) (e.g., as in a traditional door lever). Provided by way of illustration, FIG. 2B depicts such a mechanism 130. In the embodiment shown, mechanism 130 comprises a first interlocking member 134 that is rotatable about a first axis 138 (e.g., defined by a pin 132). In this embodiment, movement of a door handle lever may cause first interlocking member 134 to rotate about first axis 138. For example, in the depicted embodiment, first interlocking member 134 comprises an input portion 150, which may be coupled to the lever such that movement of the lever moves the input portion (e.g., generally along a direction indicated by arrow 154) to cause the first interlocking member to rotate about first axis 138 (e.g., generally along a direction indicated by arrow 146). In the embodiment shown, mechanism 130 comprises a second interlocking member 158 that is rotatable about a second axis 162 that is non-parallel to first axis 138 (e.g., defined by a linkage 90*a*). In this embodiment, second interlocking member 158 is coupled to first interlocking member 134 such that rotation of the first interlocking member about first axis 138 causes rotation of the second interlocking member about second axis 162 (e.g., generally along a direction indicated by arrow 166). For example, in the depicted embodiment, first interlocking member 134 comprises one or more teeth or protrusions 170 configured to mesh with and/or engage one or more teeth or protrusions 174 of second interlocking member 158. Thus, in mechanism 130, translation of input portion 150 (e.g., caused by movement of a door handle lever) may cause rotation of linkage 90*a*. In embodiments comprising mechanism 130 or similar mechanisms, linkage 90*a* may be received within a hub (e.g., 122) of a traditional door latch (e.g., 22*a*), such that rotation of the linkage rotates the hub to move a bolt between a retracted position and a deployed position.

Figure 3:
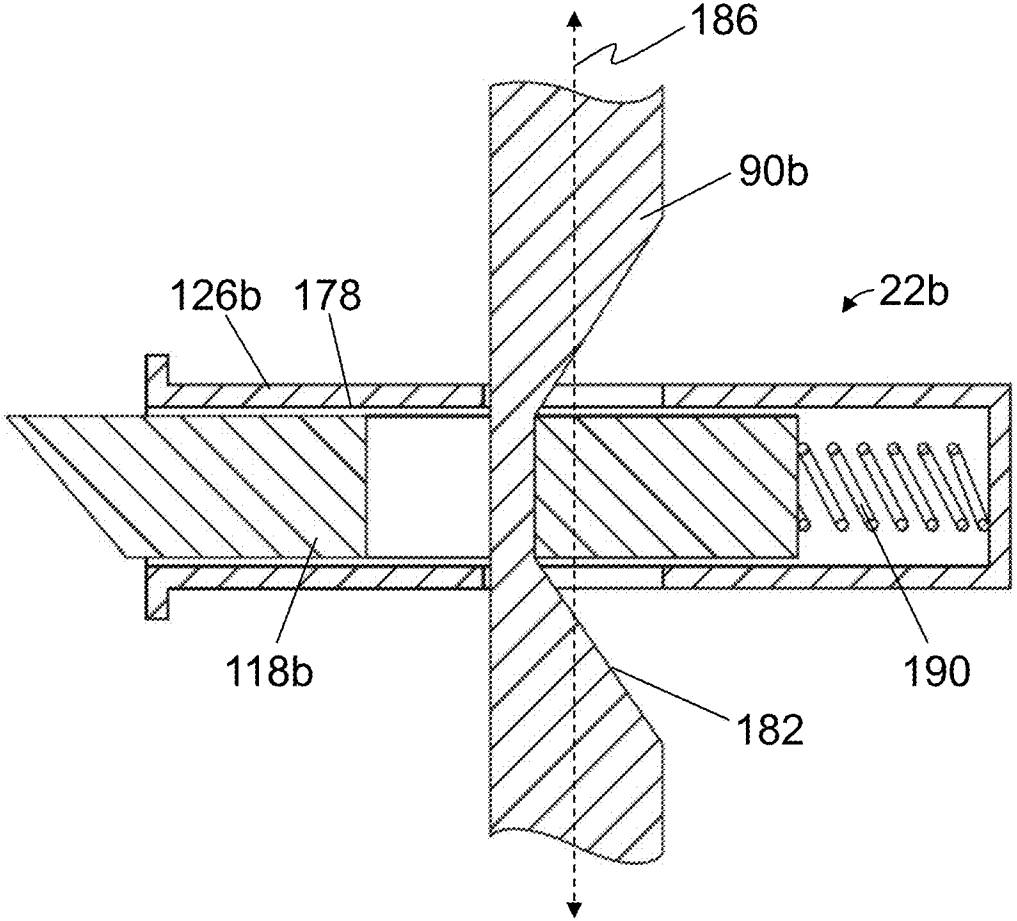
FIG. 3 is a cross-sectional top view of a door latch suitable for use with some embodiments of the present door handles.

While linkage 90*a* is configured to actuate a door latch via (e.g., axial) rotation relative to a housing (e.g., 14), in other embodiments, linkages may be configured to actuate a door latch via (e.g., axial) translation relative to a housing. For example, and referring to FIG. 3, shown is a cross-sectional top view of a door latch 22*b* suitable for use with some embodiments of the present door handles (e.g., 10*a*, 10*b*, and/or the like). In the embodiment shown, door latch 22*b* comprises a casing 126*b* defining an interior channel 178, within which a bolt 118*b* is slidably received. In this embodiment, a linkage 90*b* is slidably received through an opening of each of casing 126*b* and bolt 118*b*. In the depicted embodiment, linkage 90*b* defines a recess or depression 182 such that, as the linkage is moved relative to casing 126*b* (e.g., generally along a direction indicated by arrow 186), bolt 118*b* is moved relative to the casing between a retracted position and a deployed position. For example, linkage 90*b*, and more particularly, recess or depression 182, may define a cam surface along which a portion of bolt 118*b* slides as the linkage is moved relative to casing 126*b*, causing the bolt to move relative to the casing between the retracted position and the deployed position. In the embodiment shown, bolt 118*b* may be biased towards the deployed position, for example, via a spring 190 disposed between the bolt and casing 126*b*.

Figure 4:
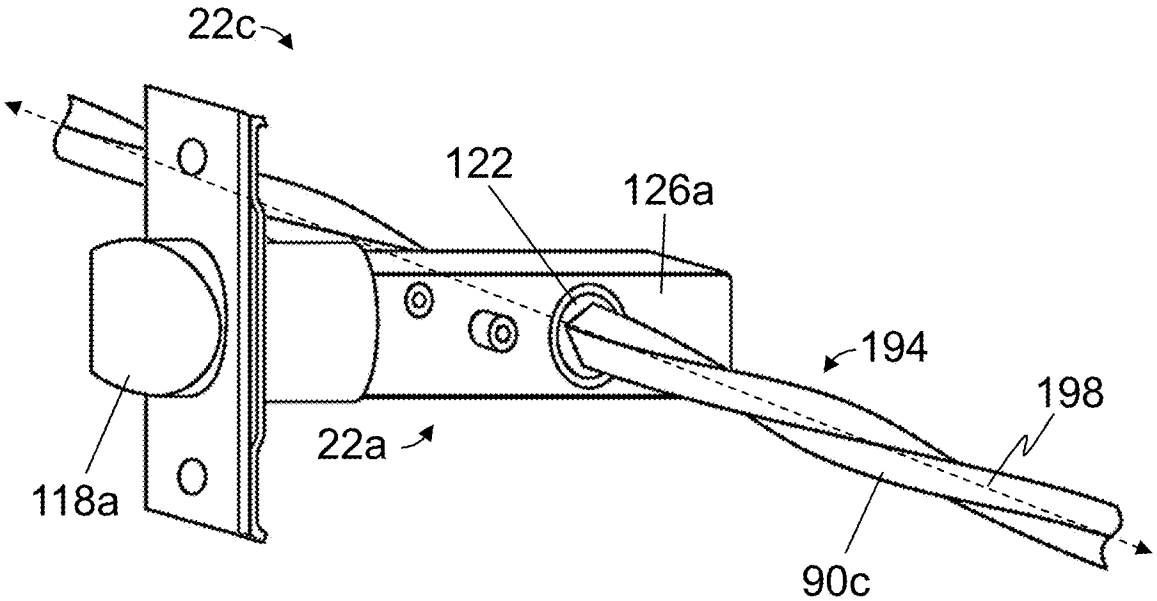
FIG. 4 is a perspective view of a door latch suitable for use with some embodiments of the present door handles.

For further example, and referring now to FIG. 4, in this embodiment, linkage 90*c*, while generally having a constant cross-sectional shape, comprises an (e.g., axially) twisted portion 194 configured to be slidably received within hub 122. In the depicted embodiment, as linkage 90*c* is moved relative to casing 126*a* (e.g., generally along a direction indicated by arrow 198), hub 122 may rotate to follow twisted portion 194, thus moving bolt 118*a* between the retracted position and the deployed position.

Figure 5A:
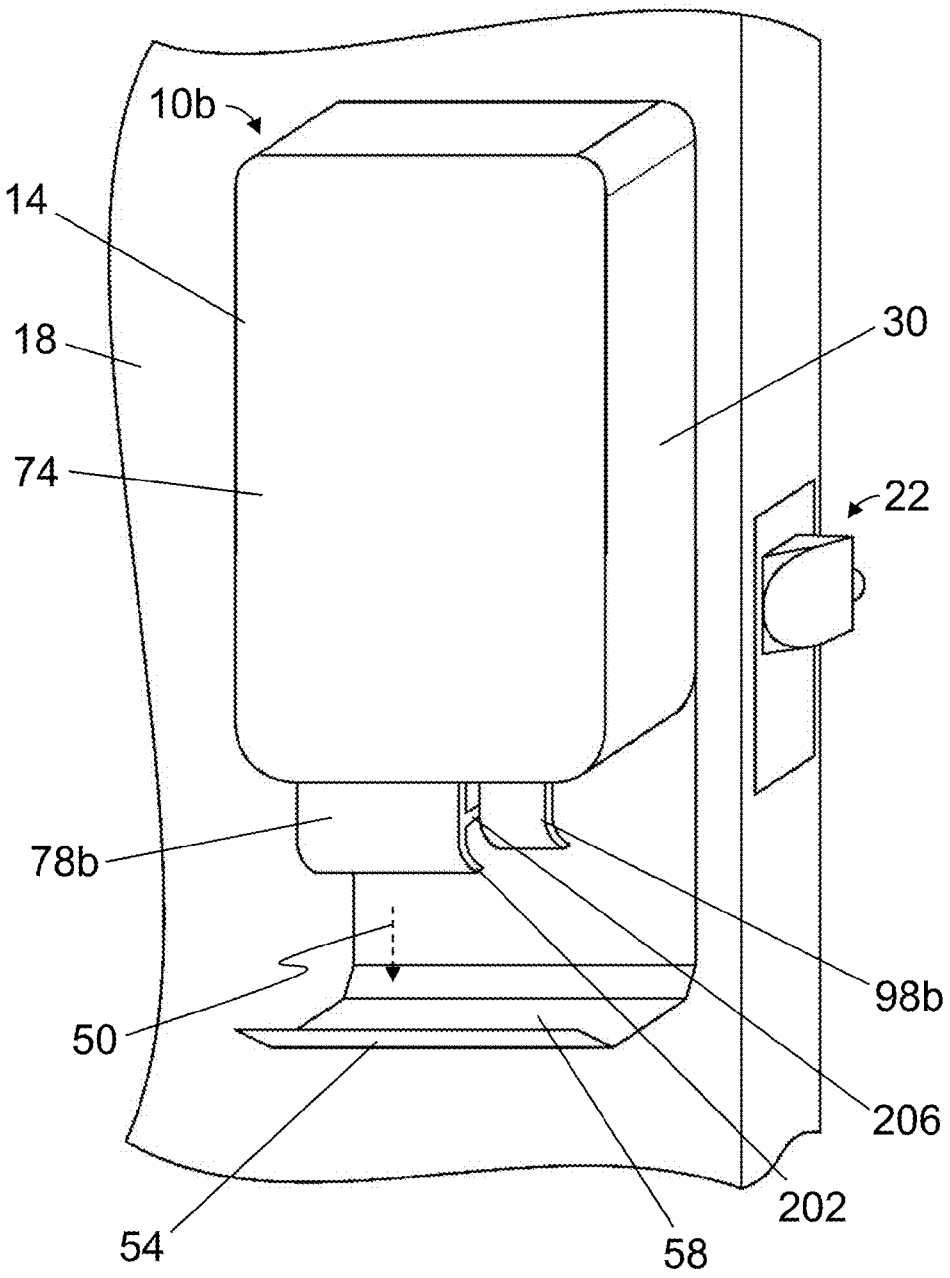
FIG. 5A is a front perspective view of a second embodiment of the present door handles.
Figure 5B:
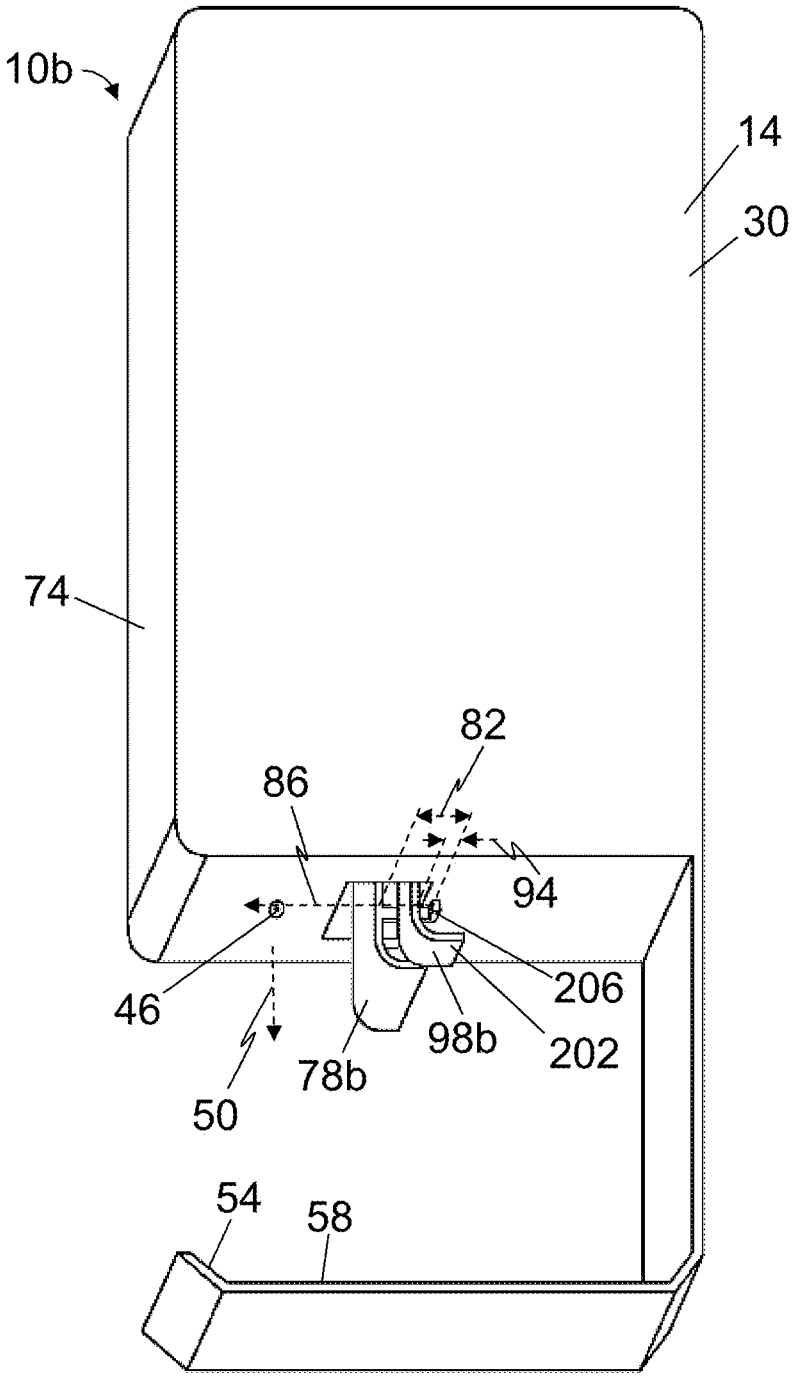
FIG. 5B is a side perspective view of the embodiment of FIG. 5A.
Figure 5C:
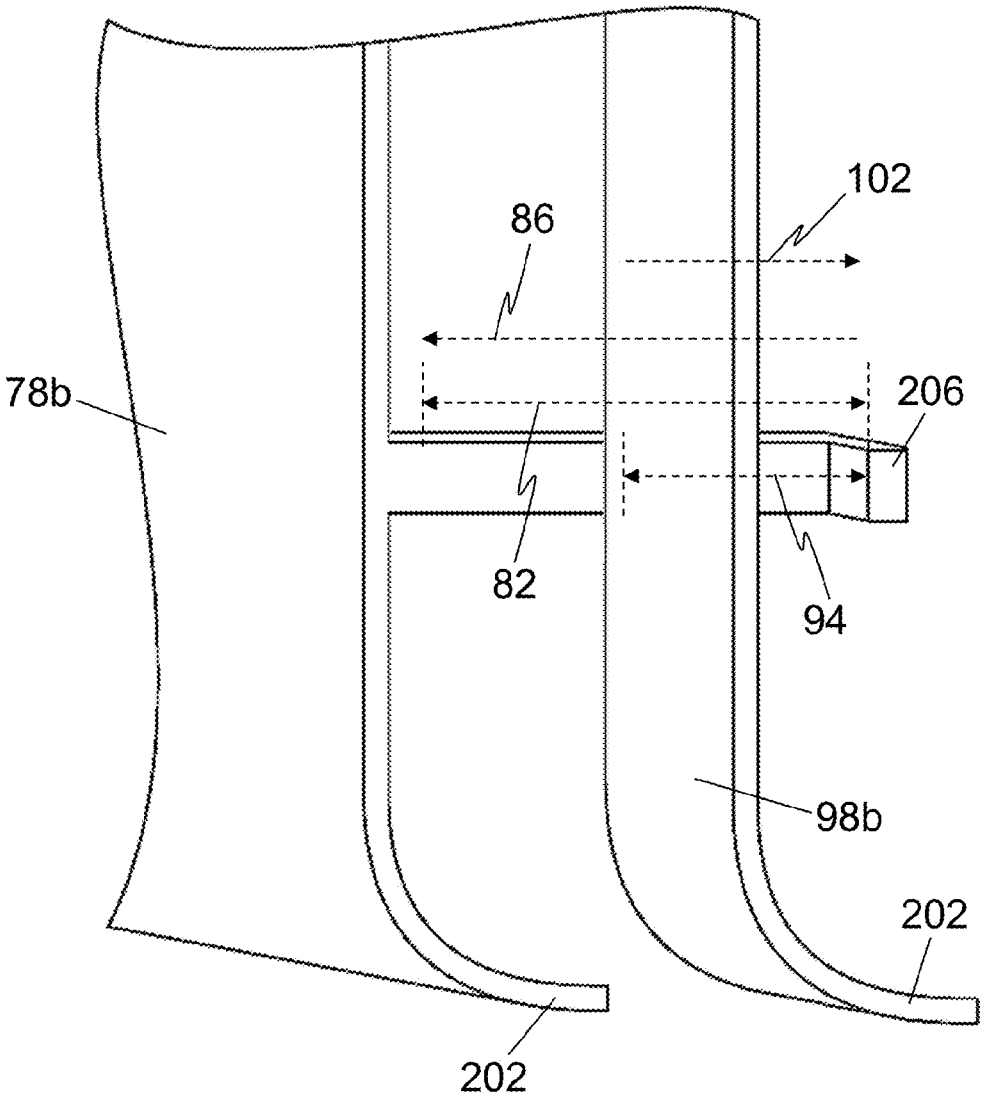
FIG. 5C is a cutaway side perspective view of levers suitable for use with the embodiment of FIG. 5A.

Referring now to FIGS. 5A-5C, shown therein and designated by the reference numeral 10*b* is a second embodiment of the present door handles. Door handle 10*b* is substantially similar to door handle 10*a*, with the primary exceptions described below. For example, in the embodiment shown, first direction 86 is generally away from door 18 (e.g., levers 78*b* and 98*b* are pull-type levers). For example, in this embodiment, first lever 78*b* and second lever 98*b* each comprise a lip or ledge 202 that extends from a portion of the lever generally in second direction 102 and is configured to facilitate a user in actuating the lever. In the depicted embodiment, first lever 78*b* comprises a projection 206 configured to engage second lever 98*b* as the first lever is moved beyond second distance 94 in first direction 86 (e.g., such that movement of the first lever first distance 82 in the first direction moves the second lever to actuate door latch 22, similarly to as described above for door handle 10*a*). Similarly to as described above for door handle 10*a*, in some embodiments, features and/or components configured to facilitate engagement of a first lever (e.g., 78*b*) with a second lever (e.g., 98*b*), such as, for example, a projection (e.g., 206), and/or the like, may be substantially disposed within a housing (e.g., 14), such that, for example, a risk of a user pinching their hand or fingers (e.g., between the first lever and the second lever) may be reduced. In the embodiment shown, nozzle 46 is disposed in front of first lever 78*b* (e.g., as opposed to behind first lever 78*b* as in door handle 10*a*).

Figure 6:
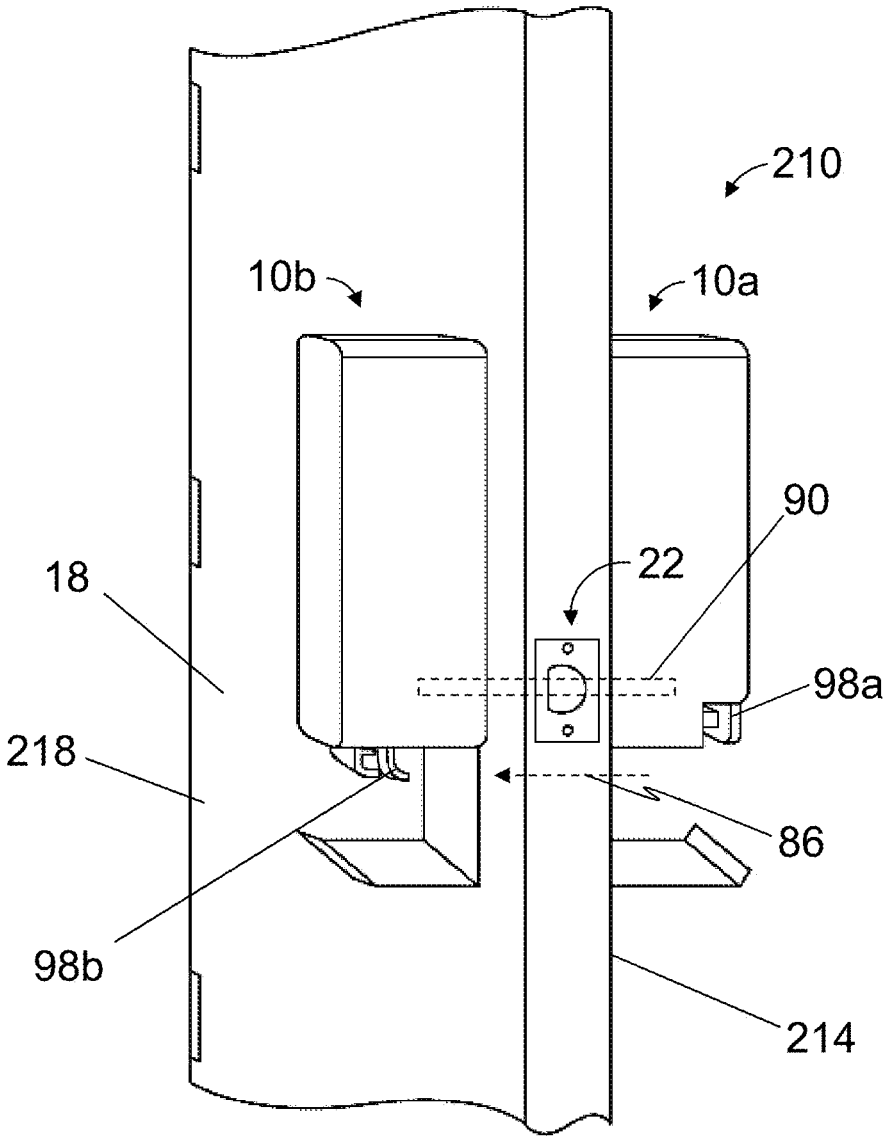
FIG. 6 is a cutaway side perspective view of one embodiment of the present door handle assemblies, including embodiments of the present door handles.

Referring now to FIG. 6, shown therein and designated by the reference numeral 210 is one embodiment of the present door handle assemblies. In the embodiment shown, assembly 210 comprises a first ("push") one of the present door handles (e.g., 10*a*) disposed on a first side 214 of door 18, and a second ("pull") one of the present door handles (e.g., 10*b*) disposed on a second side 218 of the door. In this embodiment, first door handle 10*a* is configured such that movement of second lever 98*a* in first direction 86 actuates door latch 22, and second door handle 10*b* is configured such that movement of second lever 98*b* in the first direction actuates the door latch. In some embodiments (e.g., 210), a linkage 90 of first door handle 10*a* may be coupled to and/or unitary with a linkage 90 of second door handle 10*b*. Due in part to the push-type lever configuration of first door handle 10*a* and the pull-type lever configuration of second door handle 10*b*, movement of second lever 98*b* will not cause actuation of hand sanitizer delivery system 26 of door handle 10*a*, and movement of second lever 98*a* will not cause actuation of hand sanitizer delivery system 26 of door handle 10*b*.

Some embodiments of the present methods comprise moving a first lever (e.g., 78*a*, 78*b*, and/or the like) of a door handle (e.g., 10*a*, 10*b*, and/or the like) a first distance (e.g., 82) in a first direction (e.g., 86) to actuate a door latch (e.g., 22), and moving the first lever a second distance (e.g., 94) in the first direction to actuate a hand sanitizer delivery system (e.g., 26) coupled to the door handle without actuating the door latch, where the second distance is smaller than the first distance. In some embodiments, moving the first lever the first distance moves a second lever (e.g., 98*a*, 98*b*, and/or the like) of the door handle to actuate the door latch.

Figure 7A:
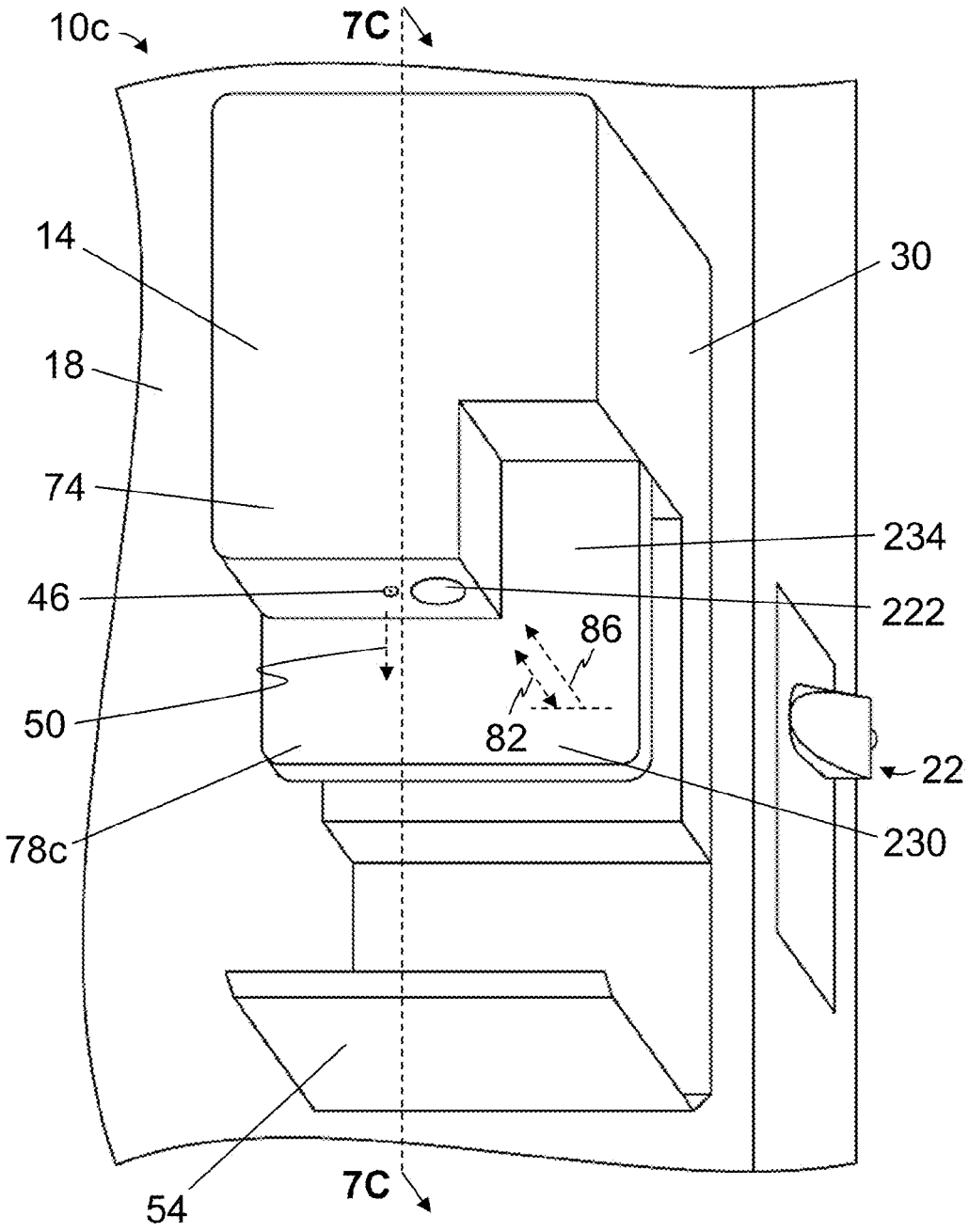
FIG. 7A is a front perspective view of a third embodiment of the present door handles.
Figure 7B:
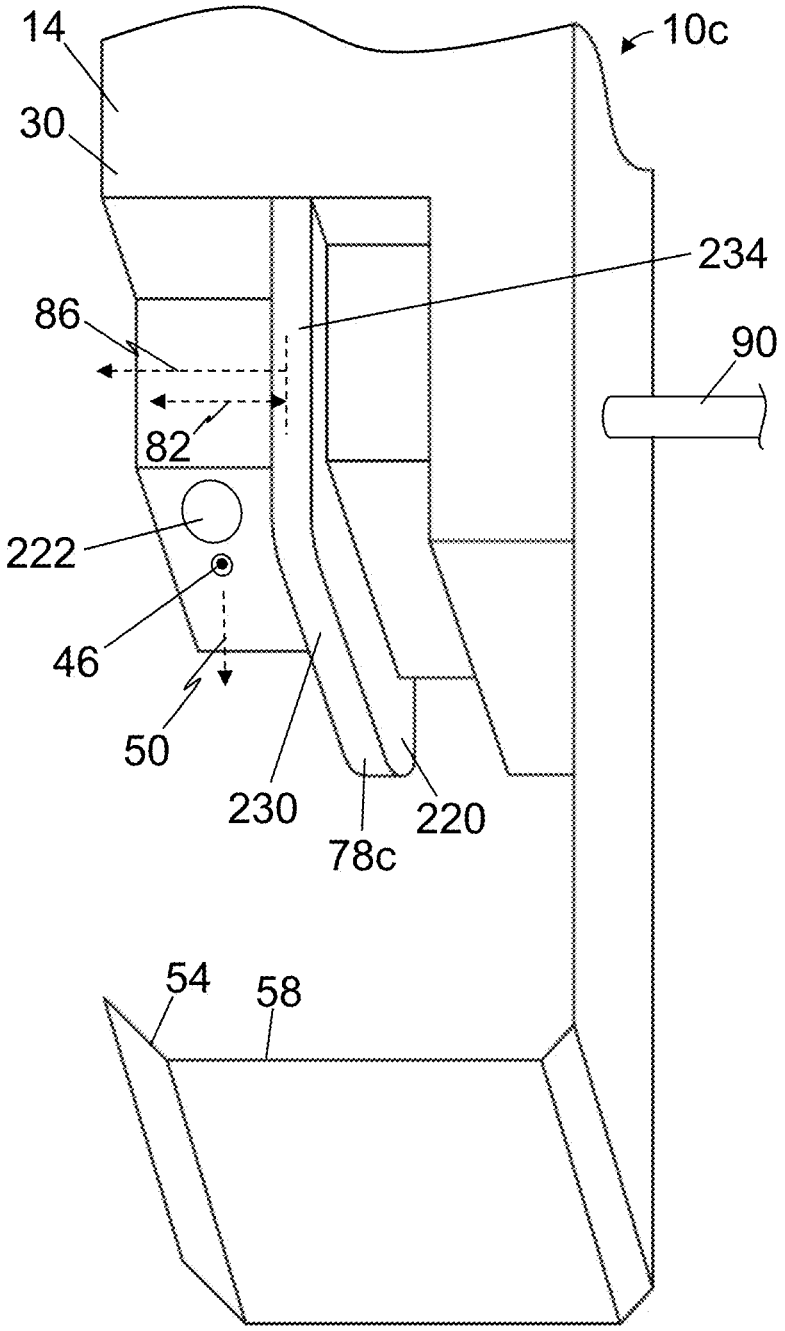
FIG. 7B is a cutaway side perspective view of the embodiment of FIG. 7A.

Referring now to FIGS. 7A and 7B, shown therein and designated by the reference numeral 10*c* is a third embodiment of the present door handles. Door handle 10*c* may be substantially similar to door handle 10*b*, with the primary exceptions described below. Similarly to door handle 10*b*, in the embodiment shown, movement of first lever 78*c* first distance 82 in first direction 86 actuates door latch 22. In this embodiment, first direction 86 is generally away from door 18 (e.g., lever 78*c* is a pull-type lever). However, in door handle 10*c*, movement of lever 78*c* alone may be sufficient to move linkage 90 to actuate door latch 22 (e.g., a second lever, such as 98*b*, may be omitted). In the depicted embodiment, movement of lever 78*c* in first direction 86 moves the lever closer to nozzle 46. In the embodiment shown, lever 78*c* defines a lip 220 configured to facilitate movement of the lever relative to housing 14 (e.g., similarly to as described above for lip or ledge 202 of lever 78*b*) (FIG. 7B).

Figure 7C:
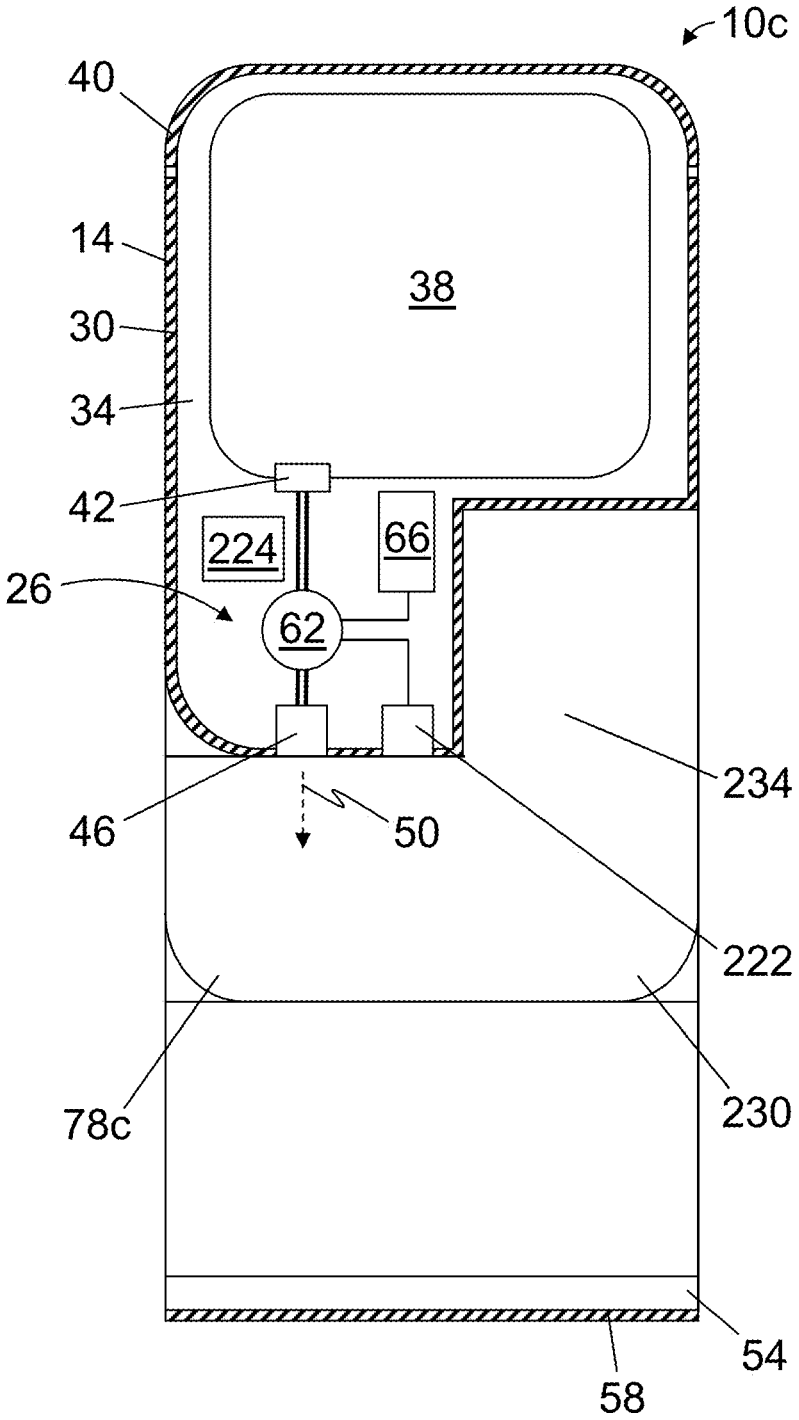
FIG. 7C is a partially cross-sectional front view taken along line 7C-7C of FIG. 7A, with various components shown schematically.

Referring additionally to FIG. 7C, in this embodiment, hand sanitizer delivery system 26 can be actuated independently of door latch 22. For example, in the depicted embodiment, door handle 10*c* comprises a sensor 222 configured to capture data indicative of a presence of an object, such as, for example, a user's hand, beneath nozzle 46 (e.g., sensor 222 may be a proximity sensor). Sensors (e.g., 222) of the present door handles can comprise any suitable sensor, such as, for example, a capacitive sensor, a light-based sensor (e.g., a laser-based sensor, an infrared sensor, and/or the like), and/or the like. In the embodiment shown, hand sanitizer delivery system 26 is configured to actuate based, at least in part, on data captured by sensor 222. For example, in this embodiment, hand sanitizer delivery system 26 is configured to actuate when data captured by sensor 222 indicates a presence of an object (e.g., a user's hand) beneath nozzle 46. In some embodiments, such sensor-based actuation of a hand sanitizer delivery system (e.g., 26) may be facilitated by a processor (e.g., 224), which may be configured to process data received from a sensor (e.g., 222) and/or command a pump (e.g., 62) of the hand sanitizer delivery system to actuate (e.g., to dispense a pre-determined amount of hand sanitizer) when data received from the sensor indicates a presence of an object beneath a nozzle (e.g., 46) of the hand sanitizer delivery system. In these ways and others, a user may, for example, place a hand under nozzle 46 to cause hand sanitizer delivery system 26 to actuate to dispense hand sanitizer, whether or not the user moves or otherwise makes contact with lever 78*c*.

In the depicted embodiment, door latch 22 can be actuated independently of hand sanitizer delivery system 26. For example, in the embodiment shown, at least a portion of lever 78*c* extends above nozzle 46 such that the lever can be moved (e.g., via contact with the at least a portion of the lever) relative to housing 14 without actuating hand sanitizer delivery system 26 (e.g., without sensor 222 capturing data indicative of a presence of an object below the nozzle). To illustrate, in this embodiment, lever 78*c* comprises a first portion 230 and a second portion 234 that extends from the first portion and above nozzle 46. In the depicted embodiment, second portion 234 is disposed at a non-parallel angle (e.g., substantially 90 degrees, as shown) relative to first portion 230. At least through portion 234 of lever 78*c*, a user may move the lever to actuate door latch 22 without being required to move beneath nozzle 46 (and thus without being required to actuate hand sanitizer delivery system 26). Nevertheless, in the embodiment shown, a user may actuate both door latch 22 and hand sanitizer delivery system 26 (e.g., in a single motion), for example, by moving lever 78*c* via contact with portion 230, thereby moving beneath nozzle 46 so as to be detected by sensor 222 and thus actuating hand sanitizer delivery system 26.

Some embodiments of the present door handles (e.g., 10*c*), and/or respective hand sanitizer delivery systems (e.g., 26) of the present door handles, may be configured to mitigate undesired actuation of a hand sanitizer delivery system that might otherwise be caused by interactions between a lever (e.g., 78*c*) and a sensor (e.g, 222). For example, in some embodiments, a sensor (e.g., 222) may be coupled to a housing (e.g., 14) and spaced from a lever (e.g., 78*c*) a distance in a first direction (e.g., 86) that is greater than a maximum distance that the lever is permitted to move relative to the housing in the first direction (e.g., such that detection of the lever by the sensor may be avoided). In some embodiments, a door handle (e.g., 10*c*), hand sanitizer delivery system (e.g., 26), sensor (e.g., 222), and/or processor (e.g., 224) may be configured to avoid actuation of the hand sanitizer delivery system based solely on a presence of a lever (e.g., 78*c*) beneath a nozzle (e.g., 46) (e.g., via configuration of the sensor, processor, and/or the like, for example, via the sensor and/or processor being configured to disregard and/or avoid detection of the presence of the lever beneath the nozzle).

Figure 8A:
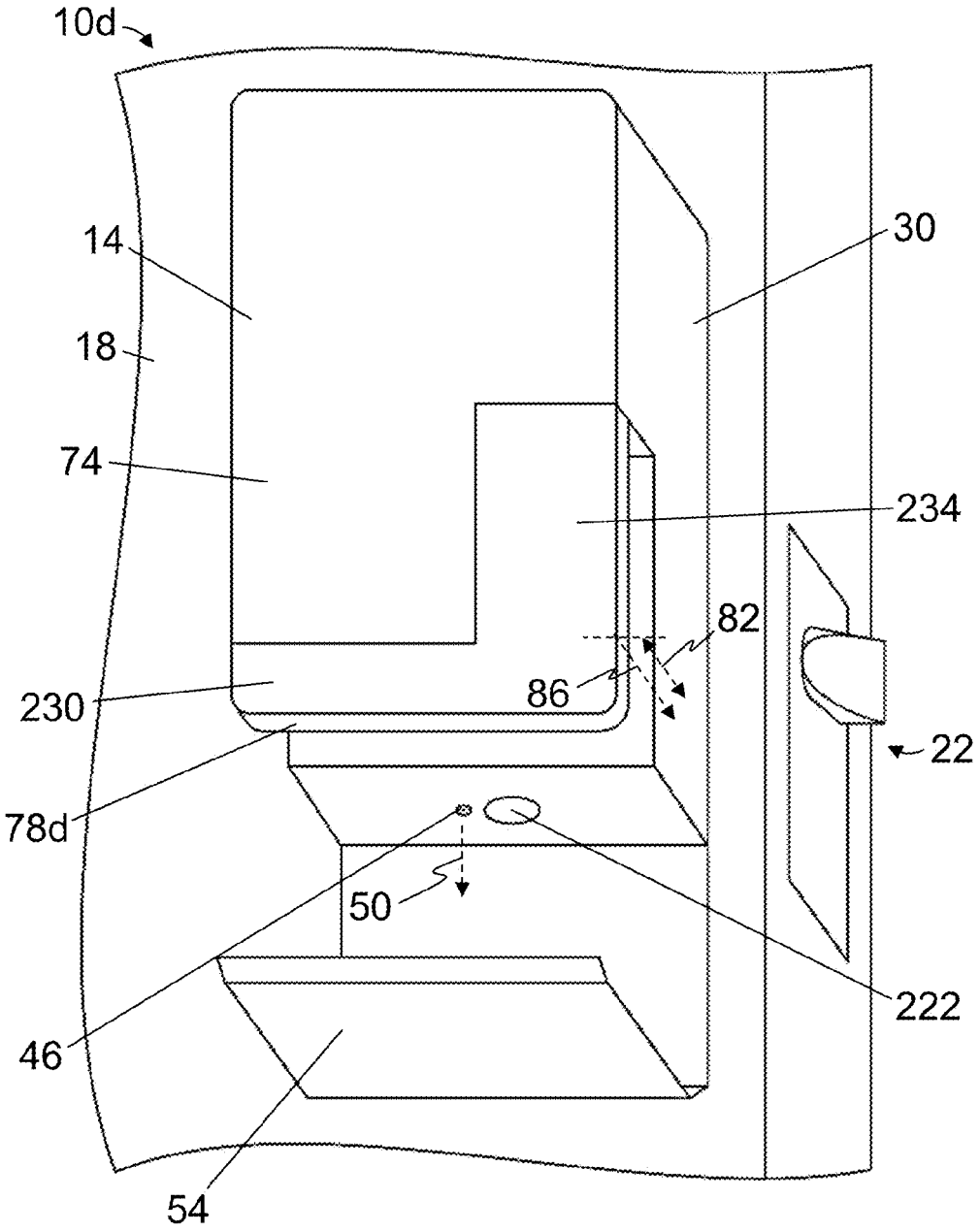
FIG. 8A is a front perspective view of a fourth embodiment of the present door handles.
Figure 8B:
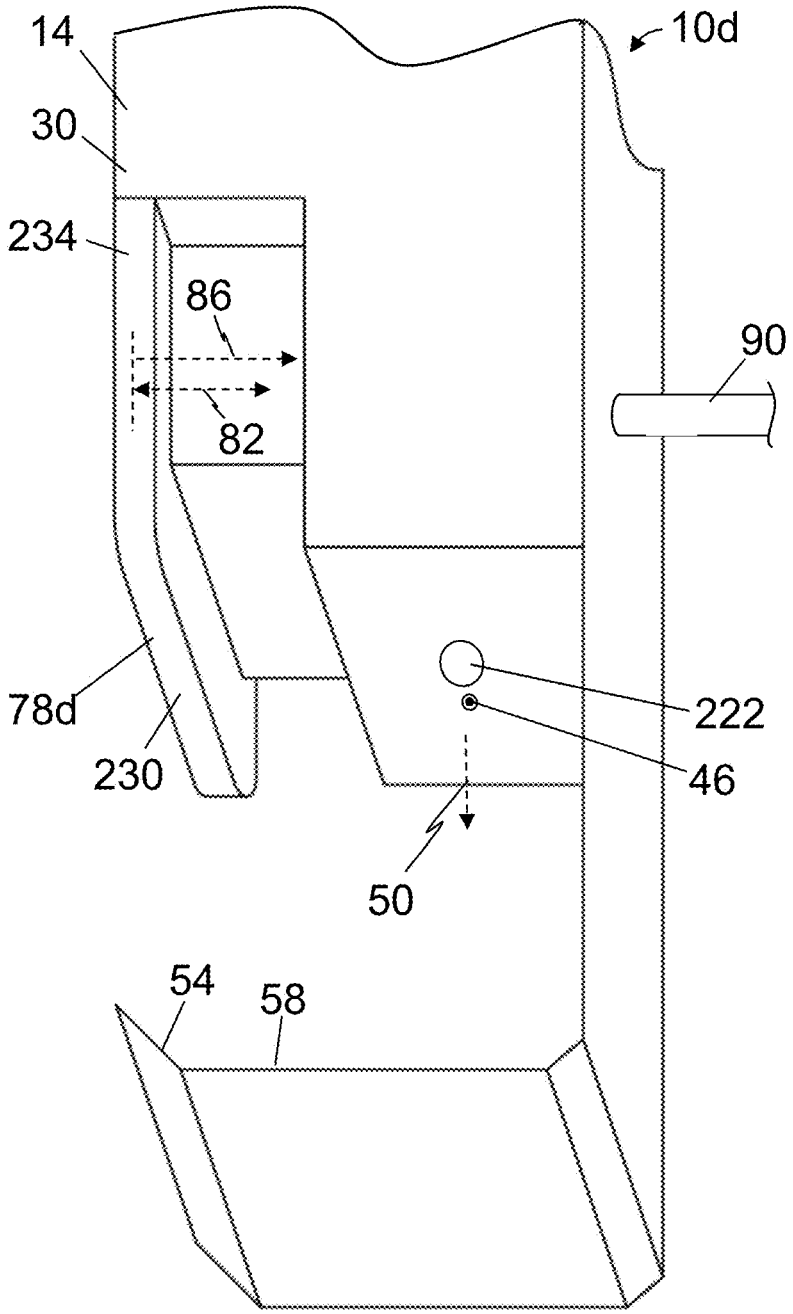
FIG. 8B is a cutaway side perspective view of the embodiment of FIG. 8A.
Figure 8C:
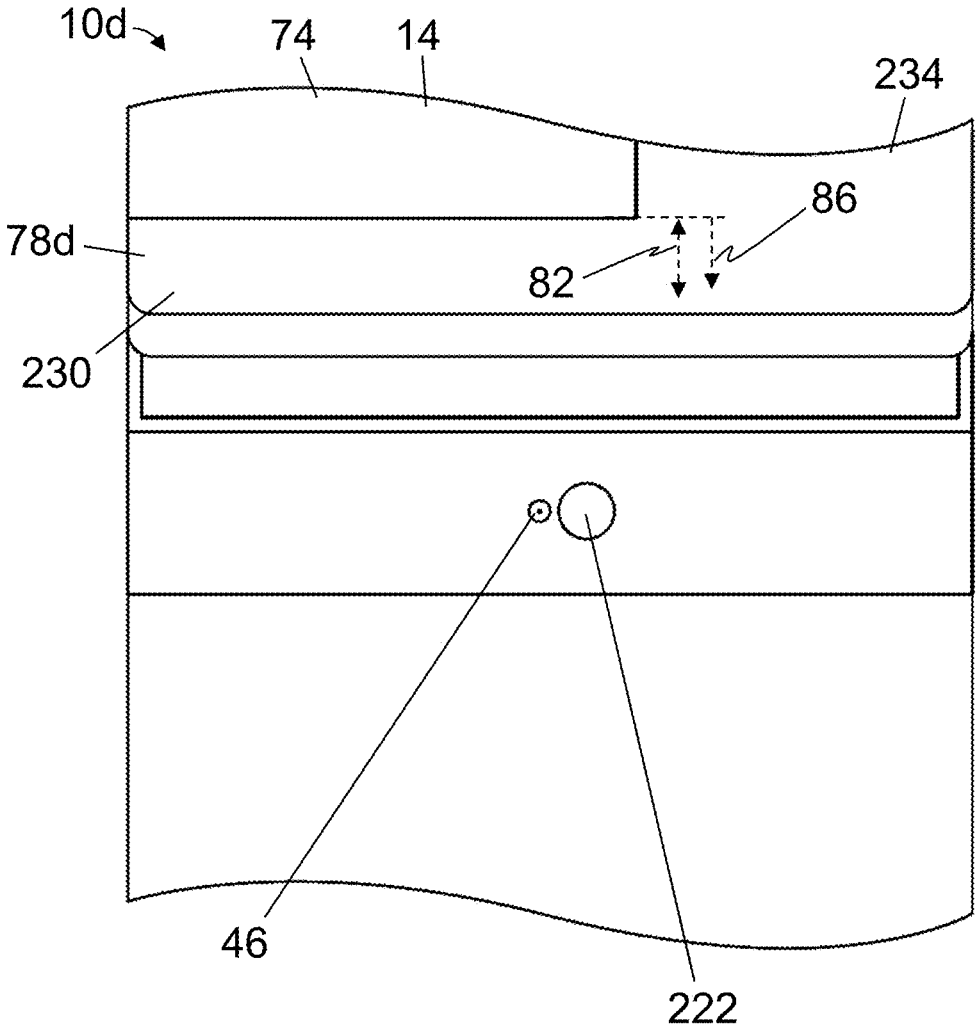
FIG. 8C is a cutaway bottom perspective view of the embodiment of FIG. 8A.

Referring now to FIGS. 8A-8C, shown therein and designated by the reference numeral 10*d* is a fourth embodiment of the present door handles. Door handle 10*d* is substantially similar to door handle 10*c*, with the primary exception that, in the embodiment shown, first direction 86 is generally towards door 18 (e.g., first lever 78*d* is a push-type lever). In this embodiment, a user may actuate door latch 22 independently of hand sanitizer delivery system 26 via contact with either portion 230 of lever 78*d* or portion 234 of the lever. For example, in the depicted embodiment, a user may move lever 78*d* via contact with portion 230 without moving beneath nozzle 46 (e.g., by the user contacting portion 230 with a closed hand). In the embodiment shown, a user may actuate both door latch 22 and hand sanitizer delivery system 26 (e.g., in a single motion), for example, by moving lever 78*d* via contact with portion 230 (e.g., with a palm of the user's hand) and moving beneath nozzle 46 (e.g., with the palm and/or fingers of the user's hand) so as to be detected by sensor 222.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A door handle comprising:
a housing;
a hand sanitizer delivery system coupled to the housing, the hand sanitizer delivery system comprising:
a reservoir configured to contain hand sanitizer;
a nozzle in selective fluid communication with the reservoir; and
a pump configured to communicate hand sanitizer from the reservoir to the nozzle; and
a first lever movably coupled to the housing;
where the housing is configured to be mounted to a door having a movable latch such that:
movement of the first lever a first distance in a first direction actuates the door latch; and
the hand sanitizer delivery system can be actuated independently of the door latch.

2. The door handle of claim 1, where the first direction is away from the door.

3. The door handle of any of claim 1, where the first direction is towards the door.

4. The door handle of claim 1, where:
the door handle comprises a sensor configured to capture data indicative of a presence of an object beneath the nozzle; and
the hand sanitizer delivery system is configured to actuate based, at least in part, on data captured by the sensor.

5. The door handle of claim 4, where at least a portion of the first lever extends above the nozzle such that the first lever can be moved relative to the housing without actuating the hand sanitizer delivery system.

6. The door handle of claim 5, where the first lever comprises:
a first portion; and
a second portion extending from the first portion and above the nozzle;
where the second portion is disposed at a non-parallel angle relative to the first portion.

7. The door handle of claim 1, where the housing is configured to be mounted to the door having the movable latch such that movement of the first lever a second distance in the first direction actuates the hand sanitizer delivery system, the second distance being smaller than the first distance.

8. The door handle of claim 1, comprising:

a second lever movably coupled to the housing and configured such that:

movement of the first lever the first distance in the first direction moves the second lever to actuate the door latch; and movement of the first lever relative to the second lever a second distance in the first direction actuates the hand sanitizer delivery system, the second distance being smaller than the first distance.

9. The door handle of claim 8, where the first lever is spaced apart from the second lever in a second direction that is opposite the first direction.

10. The door handle of claim 8, where movement of the first lever the second distance in the first direction does not move the second lever.

11. The door handle of claim 8, where movement of the second lever does not move the first lever.

12. The door handle of claim 8, where the first direction is away from the door.

13. The door handle of claim 12, where the first lever comprises a projection configured to engage the second lever.

14. The door handle of claim 8, where the first direction is towards the door.

15. The door handle of claim 14, where the first lever defines a recess configured to receive at least a portion of the second lever.

16. The door handle of claim 14, where the second lever defines a recess configured to receive at least a portion of the first lever.

17. The door handle of claim 1, comprising a drip tray coupled to the housing and disposed below the nozzle.

18. The door handle of claim 1, comprising a speaker configured to emit a sound upon actuation of the hand sanitizer delivery system.

19. A door handle comprising:

a housing;

a hand sanitizer delivery system coupled to the housing, the hand sanitizer delivery system comprising:

a reservoir configured to contain hand sanitizer;

a nozzle in selective fluid communication with the reservoir; and a pump configured to communicate hand sanitizer from the reservoir to the nozzle;

a first lever movably coupled to the housing; and a second lever movably coupled to the housing;

where the housing is configured to be mounted to a door having a movable latch such that:

movement of the first lever a first distance in a first direction moves the second lever to actuate the door latch; and movement of the first lever relative to the second lever a second distance in the first direction actuates the hand sanitizer delivery system, the second distance being smaller than the first distance.

20. A door handle assembly comprising:

a first door handle disposed on a first side of the door, the first door handle comprising:

a housing;

a hand sanitizer delivery system coupled to the housing, the hand sanitizer delivery system comprising:

a reservoir configured to contain hand sanitizer;

a nozzle in selective fluid communication with the reservoir; and a pump configured to communicate hand sanitizer from the reservoir to the nozzle; and a first lever movably coupled to the housing;

where the housing is configured to be mounted to a door having a movable latch such that:

movement of the first lever a first distance in a first direction actuates the door latch; and the hand sanitizer delivery system can be actuated independently of the door latch;

where the first direction of the first door handle is away from the door; and a second door handle disposed on a second side of the door, the second door handle comprising:

a housing;

a hand sanitizer delivery system coupled to the housing, the hand sanitizer delivery system comprising:

a reservoir configured to contain hand sanitizer;

a nozzle in selective fluid communication with the reservoir; and a pump configured to communicate hand sanitizer from the reservoir to the nozzle; and a first lever movably coupled to the housing;

where the housing is configured to be mounted to a door having a movable latch such that:

movement of the first lever a first distance in a first direction actuates the door latch; and the hand sanitizer delivery system can be actuated independently of the door latch;

where the first direction of the second door handle is away from the door; and where the first door handle is configured such that movement of the first lever the first distance in the first direction of the first door handle actuates the door latch; and where the second door handle is configured such that movement of the first lever the first distance in the first direction of the second door handle actuates the door latch.

21. A method comprising:

moving a first lever of a door handle a first distance in a first direction to actuate a door latch;

moving the first lever a second distance in the first direction to actuate a hand sanitizer delivery system coupled to the door handle without actuating the door latch;

where the second distance is smaller than the first distance; and where moving the first lever the first distance moves a second lever of the door handle to actuate the door latch.

* * * * *